US006375198B1

(12) United States Patent
Caeran et al.

(10) Patent No.: US 6,375,198 B1
(45) Date of Patent: Apr. 23, 2002

(54) SKATE WITH IN-LINE WHEELS

(75) Inventors: Francesco Caeran, Montebelluna; Mario Gonella, Conegliano; Renato Serafin, Vedelago, all of (IT)

(73) Assignee: Nordica S.p.A., Trevignano (IT)

( * ) Notice: Subject to any disclaimer, the term of this patent is extended or adjusted under 35 U.S.C. 154(b) by 0 days.

(21) Appl. No.: 09/285,789

(22) Filed: Apr. 5, 1999

Related U.S. Application Data

(63) Continuation of application No. 08/756,772, filed on Nov. 26, 1996, now Pat. No. 5,904,359, which is a continuation-in-part of application No. 08/451,621, filed on May 26, 1995, now Pat. No. 5,634,648.

(30) Foreign Application Priority Data

| | | |
|---|---|---|
| Dec. 4, 1995 | (IT) | TV95A0150 |
| Dec. 4, 1995 | (IT) | TV95A0151 |
| Dec. 4, 1995 | (IT) | TV95A0152 |
| Dec. 4, 1995 | (IT) | TV95A0149 |

(51) Int. Cl.[7] ..... A63C 17/06; A63C 17/14

(52) U.S. Cl. ..... 280/11.221; 280/11.27; 280/11.204

(58) Field of Search ..... 280/11.19, 11.2, 280/11.22, 11.26, 11.27, 11.15, 11.16, 11.34

(56) References Cited

U.S. PATENT DOCUMENTS

| | | | |
|---|---|---|---|
| 120,147 | A | 10/1871 | Boone |
| 153,946 | A | 8/1874 | Gregg |
| 211,111 | A | 1/1879 | Rush, Jr. |
| 293,299 | A | 2/1884 | Barney |
| 622,815 | A | 4/1899 | Lindsey |
| 1,228,544 | A | 6/1917 | Falstrem et al. |
| 1,603,588 | A | 10/1926 | Eberle |
| 1,702,316 | A | 2/1929 | Ridgers |
| 1,801,230 | A | 4/1931 | Fehre |
| 2,162,128 | A | 6/1939 | Shoemaker |
| 3,114,562 | A | 12/1963 | Goodman |

(List continued on next page.)

FOREIGN PATENT DOCUMENTS

| | | |
|---|---|---|
| DE | 35 42 251 A1 | 6/1987 |
| DE | 42 09 771 A1 | 9/1993 |
| EP | 2672812 | 8/1992 |
| EP | 545250 | 6/1993 |
| EP | 551704 A2 | 7/1993 |
| EP | 559179 | 9/1993 |
| EP | 568878 | 11/1993 |
| EP | 0599043 | 6/1994 |

(List continued on next page.)

OTHER PUBLICATIONS

"Affidavit of David A. Powell", Paper No. 6 in United States Patent Application Ser. No. 08/612, 083, now U.S. Pat. No. 5,957,470.

"Office Action dated May 12, 1998", Paper No. 8 in United States Patent Application Ser. No. 08/612,083, now U.S. Pat. No. 5,957,470.

Excerpt of "Patent License Agreement" of Oct. 1, 1995 between Rollerblade, Inc. and Kablooe Products, Inc.

*Primary Examiner*—Brian L. Johnson
*Assistant Examiner*—Bridget Avery
(74) *Attorney, Agent, or Firm*—Guido Modiano; Albert Josif; Daniel O'Byrne

(57) ABSTRACT

A skate with in-line wheels, including a first front body, for supporting and locking the front part of the foot, and a second rear body, for supporting and locking at least the heel, the bodies having a first frame and a second frame for supporting a plurality of wheels. The first and second bodies and the first and second supporting frames are rotatably associated to each other to allow better transmission of lateral forces during sports practice.

43 Claims, 11 Drawing Sheets

U.S. PATENT DOCUMENTS

| | | | | |
|---|---|---|---|---|
| 3,219,358 | A | | 11/1965 | Hagner |
| 3,671,051 | A | | 6/1972 | Werft |
| 3,900,203 | A | | 8/1975 | Kurulowicz |
| 3,936,061 | A | | 2/1976 | Wada |
| 3,983,643 | A | | 10/1976 | Schreyer et al. |
| 4,029,330 | A | | 6/1977 | Runyan, Jr. |
| 4,061,348 | A | | 12/1977 | Carter |
| 4,108,450 | A | | 8/1978 | Cote |
| 4,126,323 | A | | 11/1978 | Scherz |
| 4,133,548 | A | | 1/1979 | Smith |
| 4,153,263 | A | | 5/1979 | Yoshimoto |
| 4,161,326 | A | | 7/1979 | Gaber |
| 4,168,076 | A | | 9/1979 | Johnson |
| 4,272,090 | A | | 6/1981 | Wheat |
| 4,401,311 | A | | 8/1983 | Almeraz |
| 4,839,972 | A | | 6/1989 | Pack et al. |
| 4,843,740 | A | | 7/1989 | Walkhoff |
| 4,861,054 | A | | 8/1989 | Spital |
| 4,915,403 | A | | 4/1990 | Wild et al. |
| 4,955,149 | A | | 9/1990 | Ottieri |
| 5,184,834 | A | | 2/1993 | Yu |
| 5,286,043 | A | | 2/1994 | Tkaczyk |
| 5,342,071 | A | | 8/1994 | Soo |
| 5,397,141 | A | | 3/1995 | Hoshizaki et al. |
| 5,405,156 | A | | 4/1995 | Gonella |
| 5,417,444 | A | | 5/1995 | Chen |
| 5,427,391 | A | | 6/1995 | Cooper |
| 5,435,579 | A | | 7/1995 | Pozzobon |
| 5,462,297 | A | | 10/1995 | Lee |
| 5,475,936 | A | * | 12/1995 | Cavasin ..... 36/115 |
| 5,484,149 | A | | 1/1996 | Lee |
| 5,486,011 | A | | 1/1996 | Nelson |
| 5,540,455 | A | | 7/1996 | Chambers |
| 5,620,190 | A | | 4/1997 | Maggiore |
| 5,634,648 | A | | 6/1997 | Tonel et al. |
| 5,904,359 | A | * | 5/1999 | Caeran et al. ..... 280/11.15 |
| 5,957,470 | A | | 9/1999 | Powell |

FOREIGN PATENT DOCUMENTS

| | | |
|---|---|---|
| EP | 0677310 | 10/1995 |
| EP | 0 686 412 A2 | 12/1995 |
| EP | 0774282 | 5/1997 |
| FR | 764288 | 12/1931 |
| WO | 9209340 | 6/1992 |
| WO | 9211908 | 7/1992 |
| WO | 92/11908 | 7/1992 |
| WO | 93/12847 | 7/1993 |
| WO | 94/20176 | 9/1994 |

* cited by examiner

SKATE WITH IN-LINE WHEELS

CROSS-REFERENCE TO RELATED APPLICATIONS

This application is a continuation of application Ser. No. 08/756,772, filed on Nov. 26, 1996, now U.S. Pat. No. 5,904,359, which in turn is a continuation-in-part of application Ser. No. 08/451,621 filed on May 26, 1995, now U.S. Pat. No. 5,634,648.

BACKGROUND OF THE INVENTION

The present invention relates to a skate with in-line wheels.

Conventional in-line roller skates comprise a shoe comprising a quarter articulated to a shell, which has a rigid sole that is associated, in a downward region, with a usually U-shaped support or frame between the wings whereof wheels are pivoted. The wheels are thus arranged in line with respect to each other.

These conventional skates have some drawbacks: when skating, and particularly during thrusting, difficulties are in fact encountered in optimally and completely transferring the thrust imparted by the user, thus decreasing the effectiveness of the thrust and the comfort for the foot.

The user in fact tends to transmit forces mainly at the region of the foot sole lying below the metatarsal region, but the rigidity of the support and of the sole of the shoe instead force him, during thrusting, to fully rest the foot sole on the shoe sole, so that the transmitted forces are divided between the wheels that are pivoted at the front and the wheels that are pivoted at the rear, with a consequent loss of effectiveness in thrusting.

U.S. Pat. No. 5,634,648 discloses a roller skate with improved fit that is constituted by a first front body, for resting and locking the front part of the foot, and by a second rear body, for resting and locking at least the heel.

The first body and the second body are transversely rotationally associated to each other in a region that lies approximately above the pre-arch portion of the foot and in the interspace that lies between a first supporting frame and a second supporting frame for one or more wheels associated with said frames in a downward region.

Although this solution allows articulation of the shoe, it nonetheless has drawbacks; in fact, the rotation, stability, and overall rigidity of the skate are correlated only to the articulation point, which is not sufficient for their optimization.

These drawbacks are increased by the fact that during sports practice the skate is subjected, during periods of maximum thrusting, to continuous and often violent lateral stresses, as can occur for example when skating along a curve or during slalom skating or in particular during so-called "side-slip" braking.

The articulation point must therefore absorb all these applied stresses and at the same time ensure the rotation and rigidity of the shoe and good stability of the foot; however, these conditions cannot all be met simultaneously.

During skating, the foot is in fact subjected to considerable vibrations and lateral stresses that accordingly decrease the user's sensitivity in utilization and the lateral stability of the implement.

The user is also forced to increase the force in order to achieve optimum stability of the skate, with consequent tiring during exercise and reduction in comfort throughout sports practice.

SUMMARY OF THE INVENTION

A principal aim of the present invention is therefore to solve the described problems, eliminating the drawbacks of the cited prior art by providing a skate that allows the user to transmit forces in an optimum manner during thrusting, at the same time allowing a correct anatomical movement of the foot.

Within the scope of this aim, an important object is to provide a skate that allows to transmit efforts during thrusting selectively only at the front part of the foot, at the same time allowing to achieve optimum lateral support of the skate during all phases of sports practice.

Another object is to provide a skate having increased operating sensitivity and comfort, particularly during periods of maximum thrusting.

Another important object is to provide a skate that allows to achieve the necessary assurances of stability for the user throughout sports practice.

Another object is to provide a skate that can be produced at low costs and with conventional machines and equipment.

This aim, these objects, and others that will become apparent hereinafter are achieved by a skate with in-line wheels characterized in that it comprises a first member and a second member, at least one of said members being adapted to support a plurality of in-line wheels, said first member being rotatably associated with said second member.

BRIEF DESCRIPTION OF THE DRAWINGS

Further characteristics and advantages of the invention will become apparent from the following detailed description of a particular embodiment thereof, illustrated only by way of non-limitative example in the accompanying drawings, wherein.

DETAILED DESCRIPTION OF THE PREFERRED EMBODIMENTS

Figure 1:
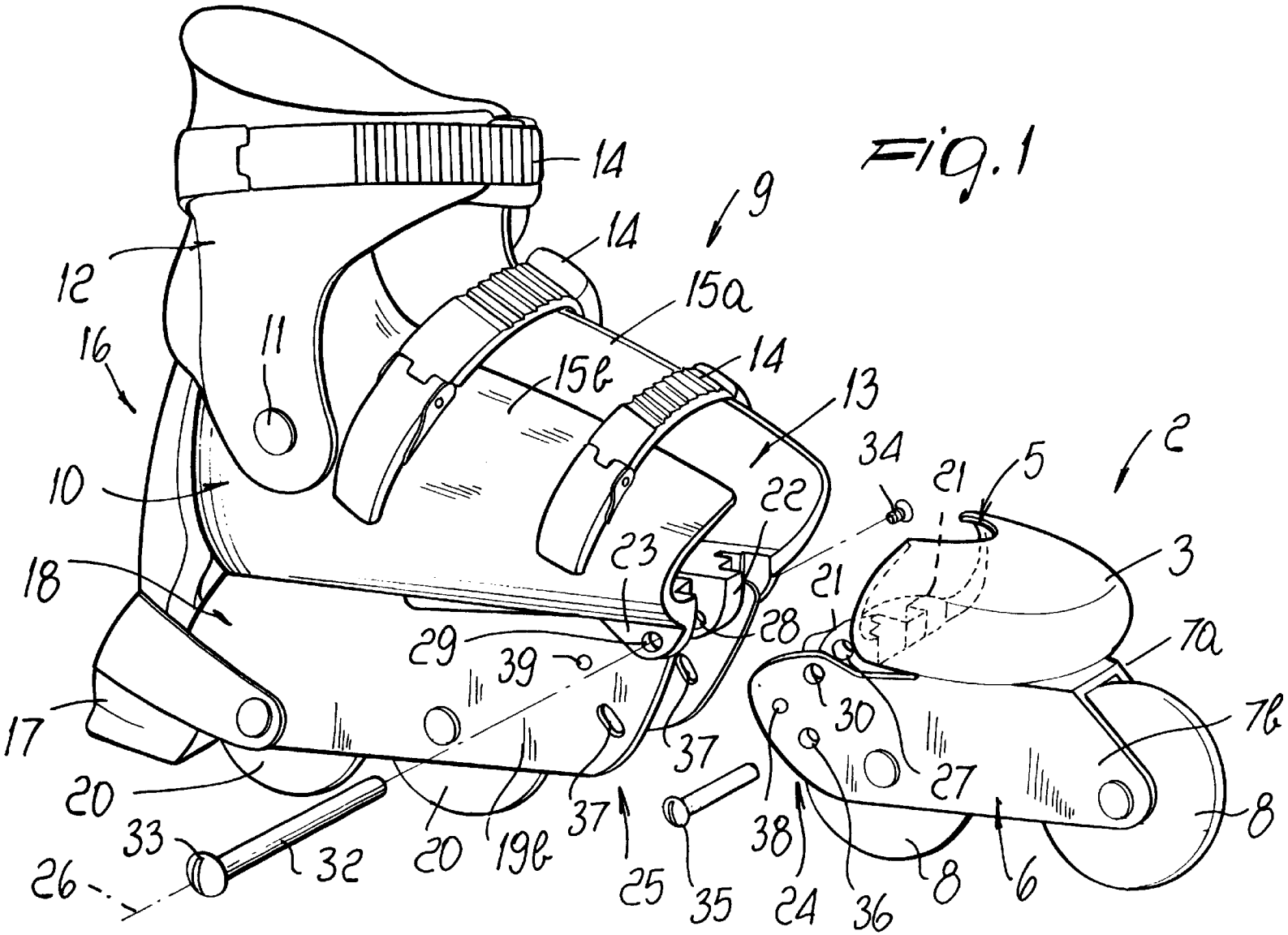
FIG. 1 is an exploded view of the skate, wherein, for the sake of clarity, the third tabs that protrude from the first body have been omitted.
Figure 2:
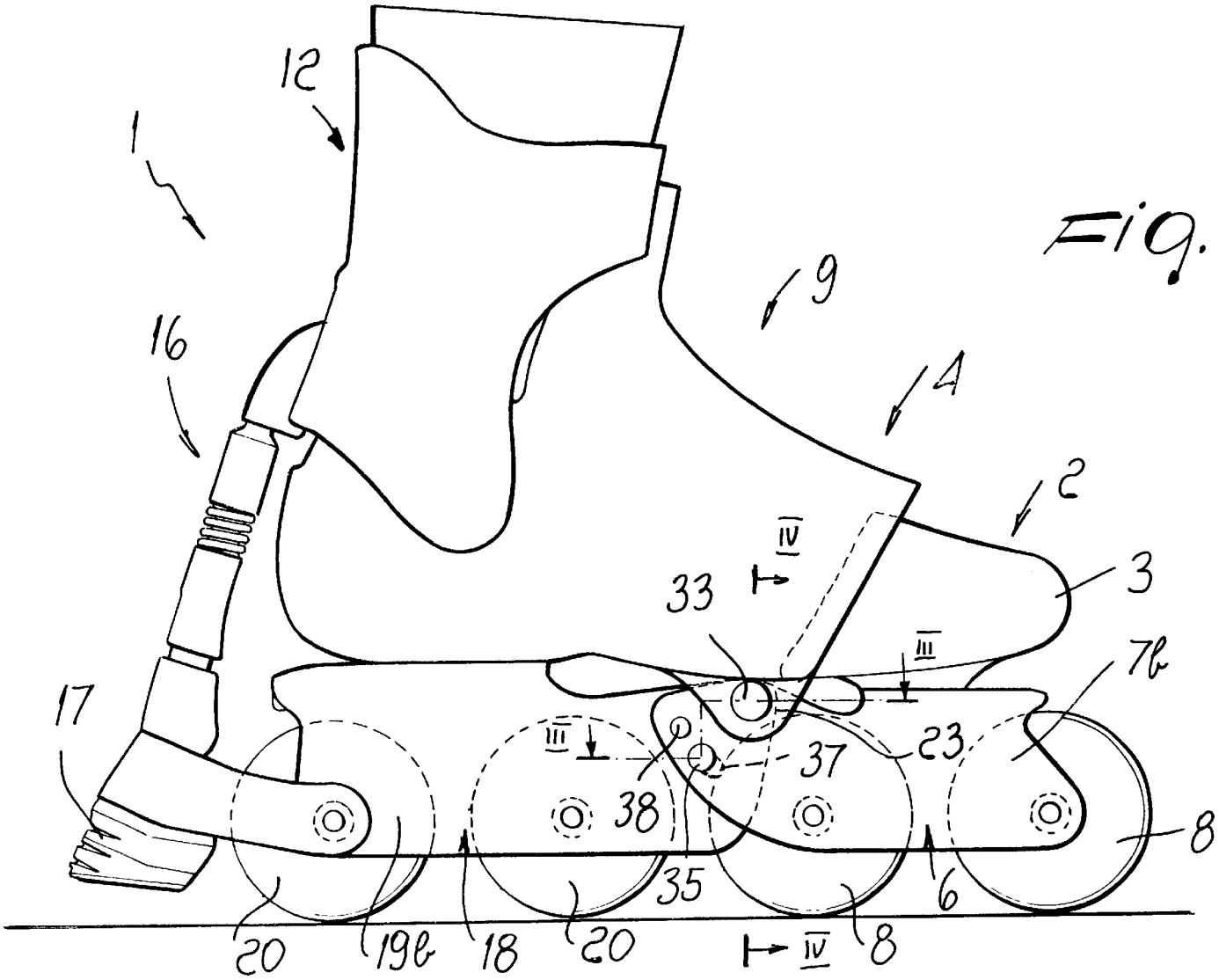
FIG. 2 is a side view of the skate, in which all the wheels touch the ground.
Figure 3:
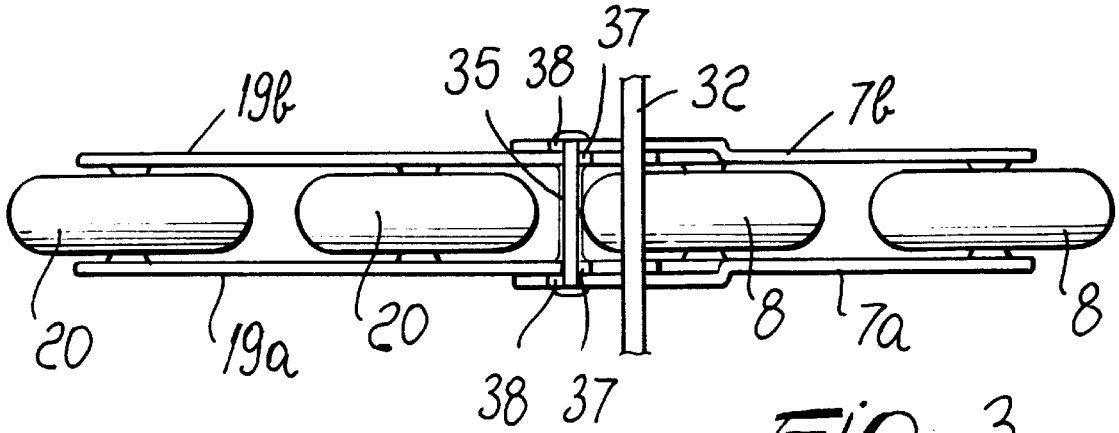
FIG. 3 is a sectional view, taken along the plane III—III of FIG. 2.
Figure 4:
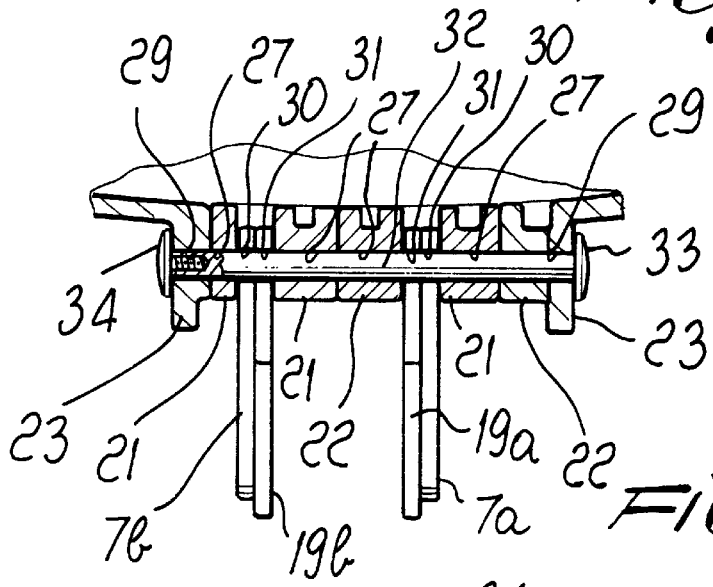
FIG. 4 is a sectional view, taken along the plane IV—IV of FIG. 2.
Figure 5:
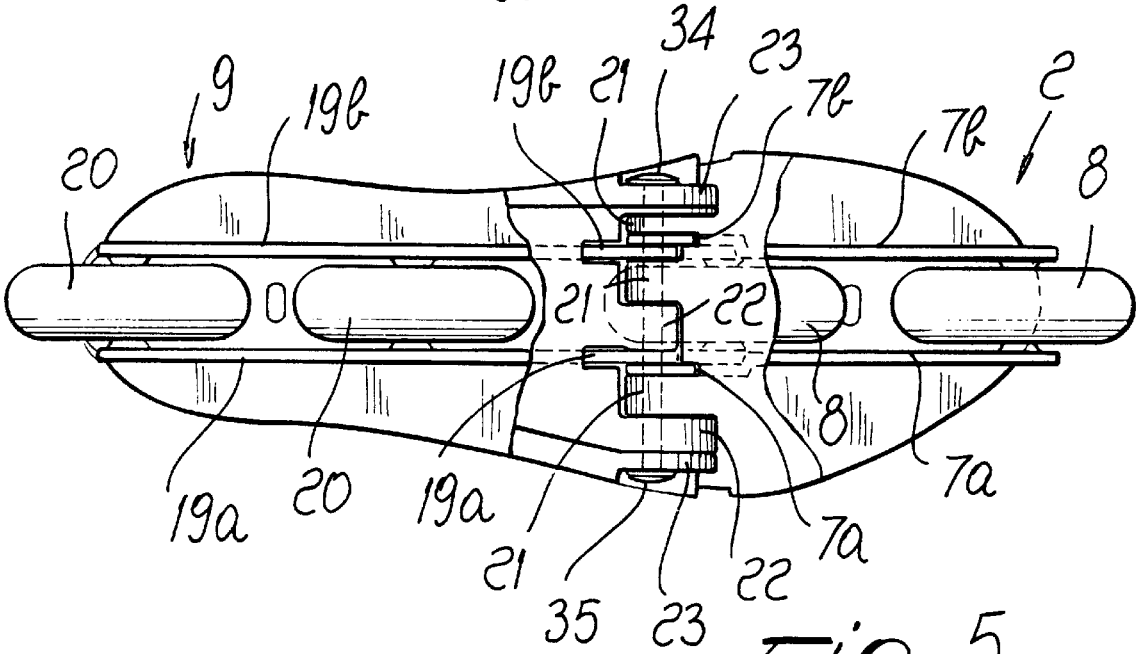
FIG. 5 is a partially sectional bottom view of the skate.
Figure 6:
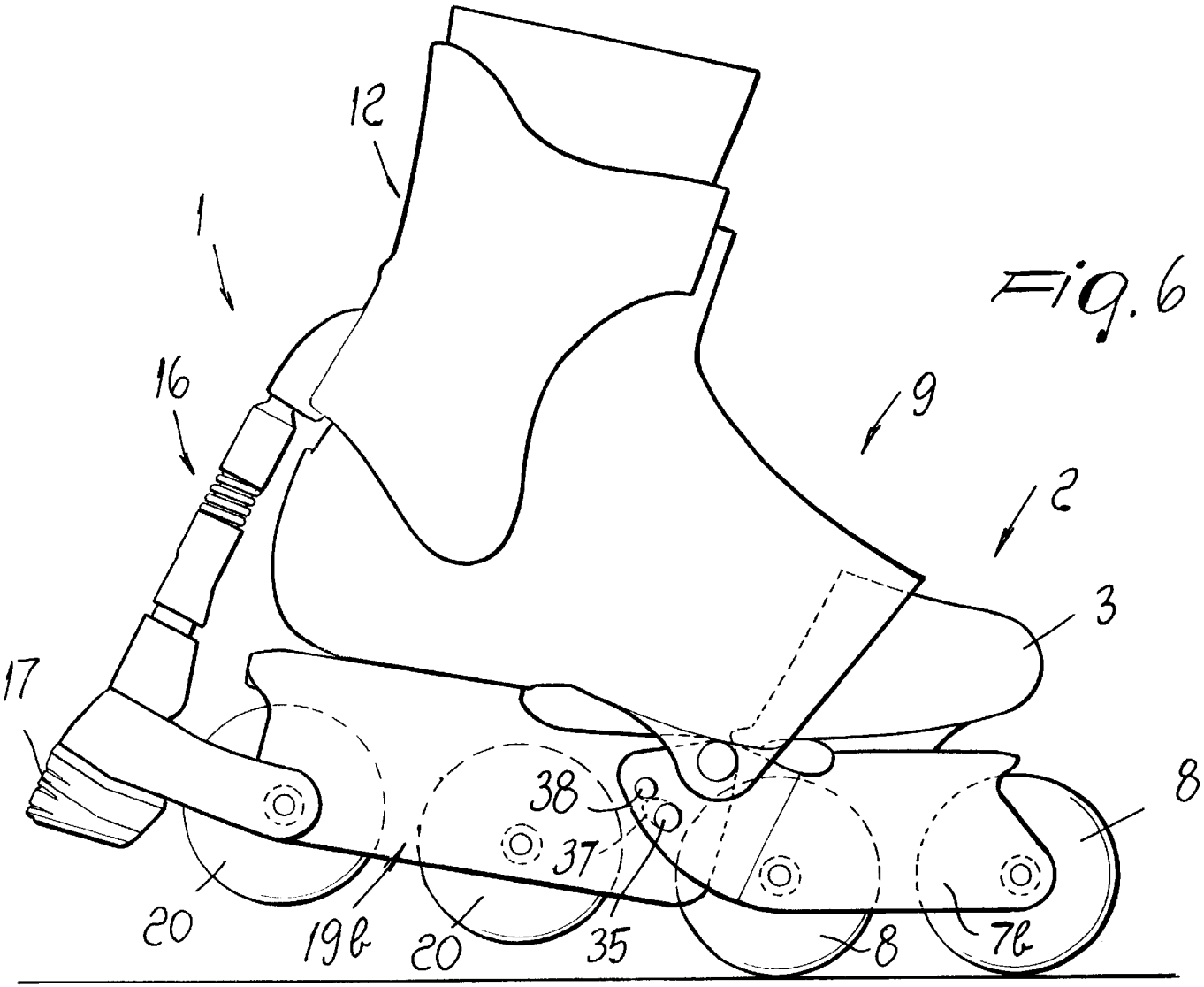
FIG. 6 is a view, similar to FIG. 2, of the skate during thrusting.

With reference to the above figures, the reference numeral 1 designates a skate that is constituted by a first front body 2 that forms the tip 3 of a shell 4 that surrounds the front region of the foot and locks it, and has an upper longitudinal slot 5.

A first supporting frame 6 is associated below the first body 2 in the particular illustrated embodiment; said frame is substantially U-shaped, and at least two first in-line wheels 8 are rotatably associated between the first wings 7*a* and 7*b* of said frame 6.

The skate comprises a second rear body 9 that is constituted by a heel cup 10 that wraps around part of the leg and of the foot up to the vicinity of the foot flexing region; a cuff 12 that wraps around the tibial region is optionally but not necessarily pivoted laterally to said heel cup at an adapted pair of studs 11.

The second rear body 9 also has a longitudinal front opening 13 for the insertion of, for example, a soft innerboot or directly of the user's foot; the foot is secured by adapted levers 14 that transversely connect the flaps 15*a* and 15*b* of the second rear body 9.

An adapted brake 16 can be associated at the cuff 12 and has a pad 17 that interacts with the ground when said cuff is rotated backwards.

A second supporting frame 18 is associated below the heel region of the second body 9; in a transverse cross- section said frame is U-shaped, and second in-line wheels 20 are rotatably associated between the second wings 19*a* and 19*b* of said second frame.

The first body and the second body, as well as the first and second supporting frames, are transversely and rotatably associated together, and guiding and sliding means are provided on said first and second frames.

Rotary coupling is allowed by the presence of a plurality of first tabs 21 that protrude downward and axially with respect to the first body 2, both in the interspace lying between the two first wings 7*a* and 7*b* of the first frame 6 and outside the frame, and by a plurality of second tabs 22, which protrude downward and axially at the end of the second body 2 that is directed towards the first body 6, both in the interspace lying between the second wings 19*a* and 19*b* and in a region lying outside them.

The first and second tabs therefore have a comb-shaped configuration and can be arranged adjacent to each other when the first body 2 is joined axially to the second body 9.

Third tabs 23 protrude, at the end of the second body 9 that has the second tabs 22, below the second wings 19*a* and 19*b* and outside them.

Adapted first holes 27, second hole 28, third holes 29, fourth holes 30, and fifth holes 31 are formed, along the same axis 26, on the first, second, and third tabs, as well as on the first ends 24 and on the second ends 25 of the first frame 6 and of the second frame 18; all of said holes form a seat for a first pivot 32.

Said first pivot 32 has a head 33 that abuts against one of the third tabs 23 and a stem that is internally threaded, at the other end, for coupling to a complementarily threaded first screw 34 that abuts at the other third tab 23.

The skate furthermore comprises guiding and sliding means provided on the first and on the second frames; said means are constituted by a second pivot 35 that passes at two sixth holes 36 formed at the ends of the first wings 7*a* and 7*b* that partially laterally wrap around the corresponding ends of the second wings 19*a* and 19*b* of the second frame 18.

The sliding of the first and second ends of the first and second frames is allowed by the presence of two adapted slots 37 that are formed on the ends of the second wings 19*a* and 19*b*; said slots have a curved shape that allows the second body 9 to rise from the ground during thrusting, when the first wheels 8 are in contact with said ground.

The two slots 37 are of course formed on the second wings 19*a* and 19*b* at the sixth holes 36 provided on the first wings 7*a* and 7*b* of the first frame 6.

A seventh hole 38 and an eighth hole 39 are advantageously formed, respectively on the first wings and on the second wings of the first and second frames, so that they are adjacent to the sixth holes 36 and to the pair of slots 37; said holes 38 and 39 have the same axis when both the first wheels 8 and the second wheels 20 interact with the ground and therefore when the skate is in a horizontal condition.

In this condition it is thus possible, by inserting a pin or pivot in the seventh hole 38 and in the eighth hole 39, to lock the sliding of the first and second frames, which therefore cannot rotate at the axis 26.

The first pivot 32 and the second pivot 35 of course act at the interspace between a first wheel 8 and a second wheel 20 that are adjacent to each other.

Use of the invention is thus as follows: once the first and second frames and the first and second bodies have been associated one another by means of the first pivot 32 and the second pivot 35, the skater can achieve optimum lateral thrusting, since the second body can rotate, rising from the ground, allowing to concentrate the forces on the first wheels 8, while lateral forces can still be transmitted by virtue of the partial overlap of the first and second wings of the first and second frames; the sliding of the second pivot 35 in the slot 37 allows to achieve guided lifting of the second frame 18 with respect to the first frame 6.

It has thus been observed that the invention has achieved the intended aim and objects, a skate having been obtained which allows the user to transmit forces in an optimum manner during thrusting, at the same time allowing a correct anatomical movement of the foot; during thrusting, said forces can be selectively concentrated exclusively at the front part of the foot, at the same time allowing to achieve optimum lateral containment of the skate throughout sports practice.

The invention is of course susceptible of numerous modifications and variations, all of which are within the scope of the same inventive concept.

Figure 7:
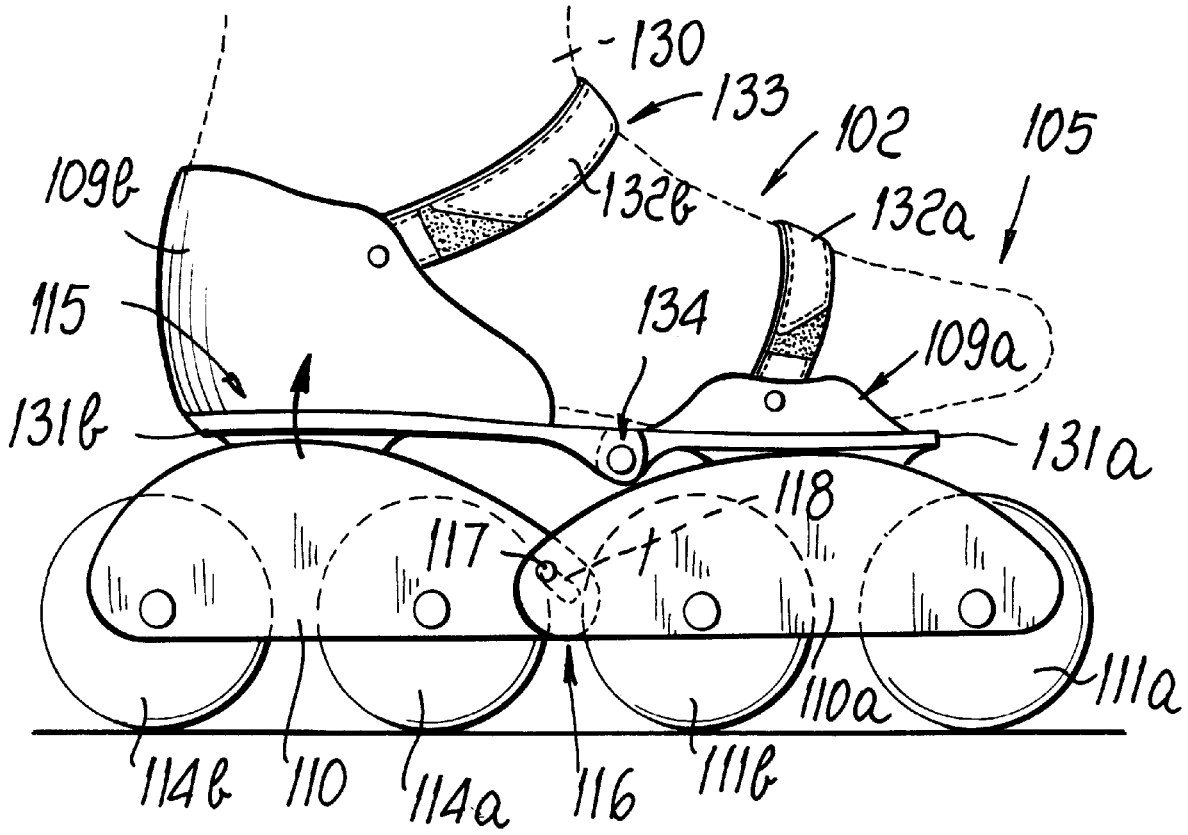
FIG. 7 is a view of a further embodiment.
Figure 8:
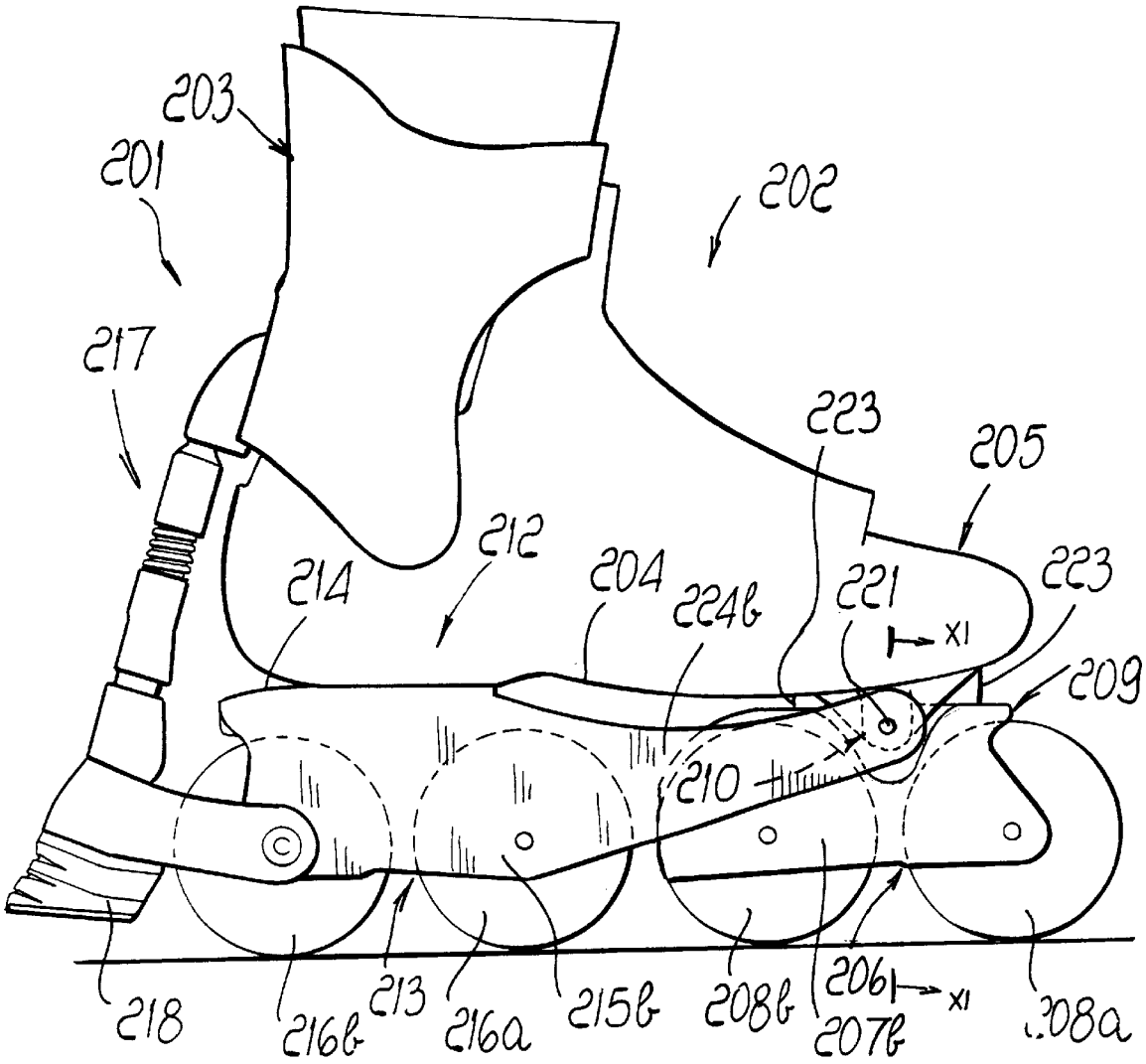
FIG. 8 is a side view of the skate with in-line wheels in the inactive condition.
Figure 9:
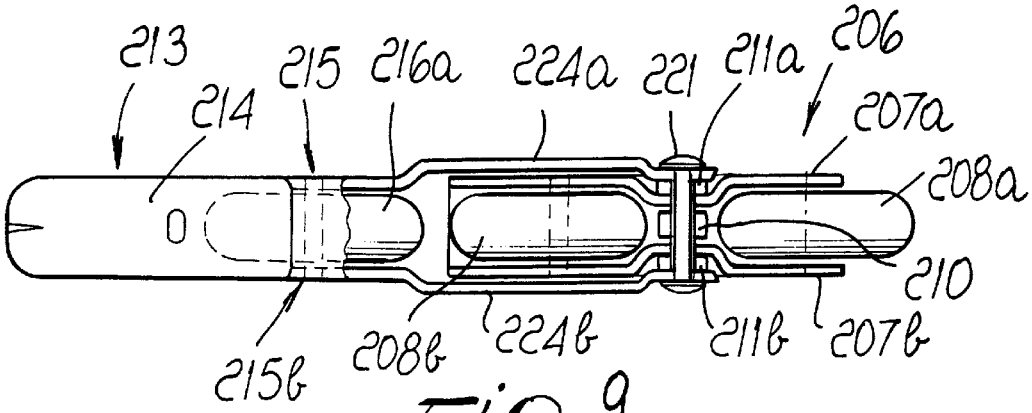
FIG. 9 is a partially sectional top view, taken at the tip region of the shell.

Thus, for example, FIG. 7 illustrates a second embodiment, in which the reference numeral 101 designates a skate constituted by a shell 102 with which a quarter, not shown, can be articulated at the malleolar region by means of appropriate studs or rivets.

The shell 102 is constituted by a first body 109*a*, which is U-shaped in transverse cross-section and is constituted by a first flat support 131*a*, from which two lateral shoulders protrude upwardly; said shoulders allow to contain the front part of a shoe 130 or the foot at the tip region 105.

The first body 109*a* has a first strap 132*a* the ends whereof are associable with the two lateral shoulders; said first strap 132*a* allows to secure the shoe 130 or the foot.

The shell 102 has a second body 109*b*, which is constituted by a second flat support 131*b*, from which a heel cup protrudes perimetrically and upwardly and is adapted to contain at least the heel region 115 of the shoe 130.

The second body 109*b* has a second strap 132*b* the ends whereof are laterally associated with the heel cup; said strap provides securing at the foot instep region 133.

The first and second bodies 109*a* and 109*b* can be transversely and rotatably associated, at their ends which can be placed adjacent to each other, by means of a hinge- like articulation that comprises an adapted screw or a connecting pivot 134.

A first frame 110*a* and a second frame 110*b* are associated respectively with the first body 109*a* and with the second body 109*b*; both frames are U-shaped, and at least two first and second wheels 111*a* and 111*b*, 114*a* and 114*b* are respectively pivoted between the first and second wings, which protrude downwardly, of said frames.

The center distance of the second wings of the second frame 110*b* is smaller than the center distance of the first wings of the first frame 110*a*, so as to allow the partial insertion and adjacent arrangement of the second wings with respect to the first wings on an approximately parallel plane.

The first frame 110*a* and the second frame 110*b* have means 116 for mutual guiding and sliding.

Said means 116 are constituted by a pin 117 that is associated and blended, at right angles, with the tips of the first wings of the first frame 110*a* in a region that is intermediate between two of said first and second wheels that are adjacent to each other; the first pin 117 slides at a slot 118 that is formed on the second wings of the second frame 110*b* that are arranged adjacent to the first wings of the first frame 110*a*.

The slot 118 is arc-shaped, with its concavity directed at the tip region 105.

This solution, too, allows to achieve the intended aim and objects.

With reference to FIGS. 8–11, the reference numeral 201 designates a skate constituted by a shell 202, to which it is possible to articulate a quarter 203 associated at the malleolar region by means of appropriate studs or rivets.

The shell 202 is formed monolithically, is preferably made of plastics, and has a lower region that forms a sole 204.

A first frame 206 is associated below the sole 204 in the metatarsal region 205 and is U-shaped in transverse cross-section; at least one pair of first wheels 208*a* and 208*b* is pivoted between the first wings 207*a* and 207*b* of said first frame, which protrude towards the ground.

The first frame 206 has a first base 209 for connecting the first wings 207*a* and 207*b* said base is perforated, so as to form a seat for the positioning of a first tab 210 in said base, and said first tab protrudes below the sole 204 in the metatarsal region 205.

A pair of second tabs 211*a* and 211*b* also protrudes below the sole 204 so as to lie approximately parallel to the first tab; said second tabs are arranged externally with respect to the first wings 207*a* and 207*b* of the first frame.

A second frame 213 is associated below the sole 204, approximately at the heel region 212; said second frame, too, is U-shaped in transverse cross-section, forming a second base 214 for anchoring to the sole 204, two second wings 215*a* and 215*b* protruding from said second base, at least one pair of second wheels 216*a* and 216*b* being pivoted between said second wings.

An adapted brake 217 is advantageously associable at the quarter 203 and has a pad 218 that interacts with the ground when said cuff is rotated backwards.

A first hole 219 and second holes 220*a*, 220*b* are formed, along the same axis, respectively at the first tab 210 and at the second tabs 211*a* and 211*b* ; said holes accommodate a pivot 221 that also passes at adapted third holes 222*a* and 222*b* formed at the first wings 207*a* and 207*b* of the first frame 206 proximate to the first base 209.

At least one means adapted to limit the oscillation of the second frame 213 and/or of the shell 202 is interposed between the lower surface of the sole 204 and the first base 209; the means is constituted by a flexible insert 223 that is preferably rectangular in plan view and has a hole which allows the insertion of the first tab 210.

The second frame 213 has two third tabs 224*a* and 224*b* that protrude from the second wings 215*a* and 215*b* towards the first frame 206 and have such a length and size as to be arranged laterally adjacent outside the second tabs 211*a* and 211*b* that protrude from the sole 204 and the ends of the first wings 207*a* and 207*b* of the first frame that are adjacent to the first base 209.

Advantageously, the profiles of the first wings and of the pair of third tabs have narrower portions that allow to contain the length of the pivot 221.

The two third tabs 224*a* and 224*b* are slightly curved towards the sole 204, and are perforated at the tip in order to be pivoted to the pivot 221.

Figure 10:
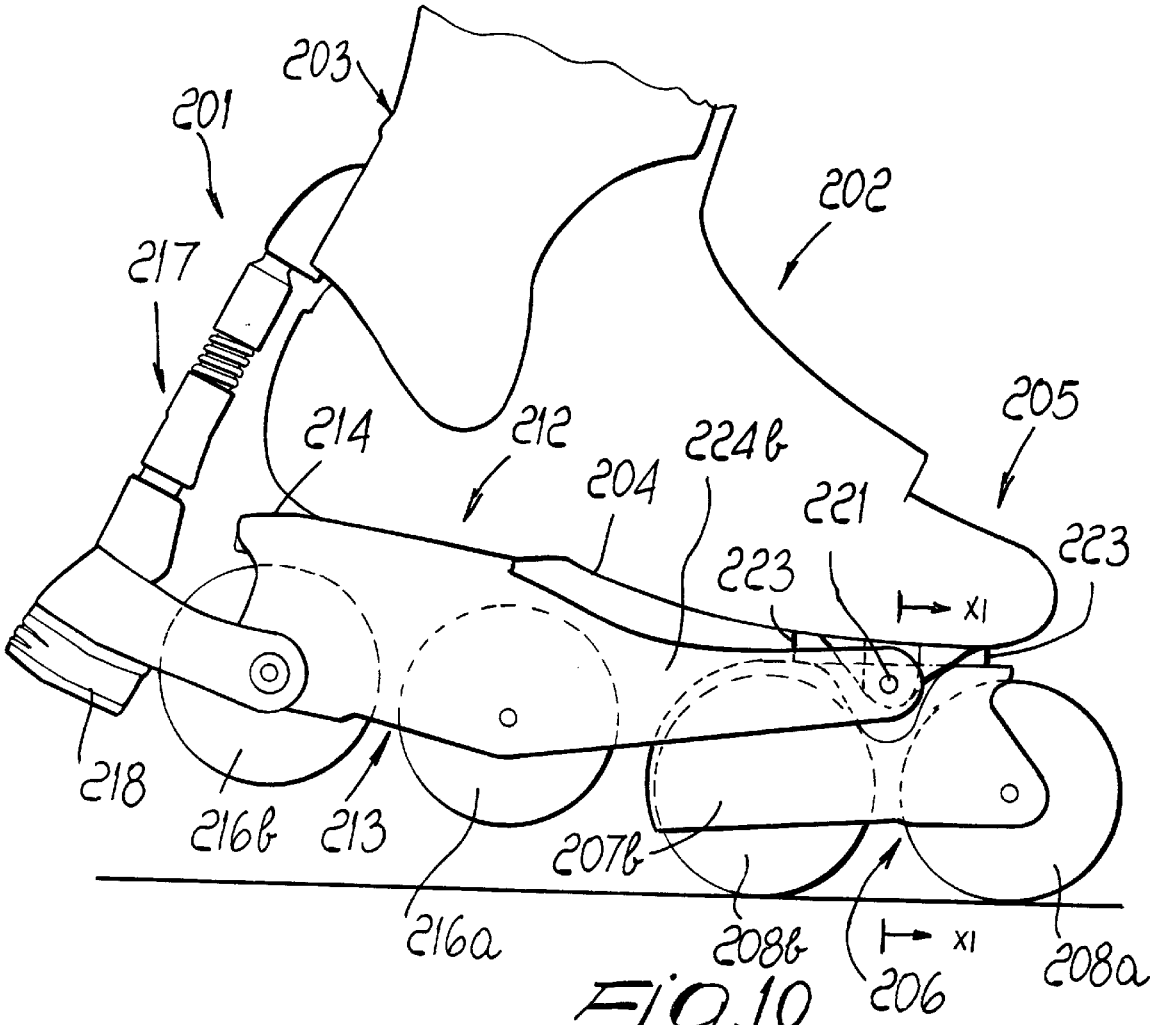
FIG. 10 is a side view of the skate during thrusting while skating.
Figure 11:
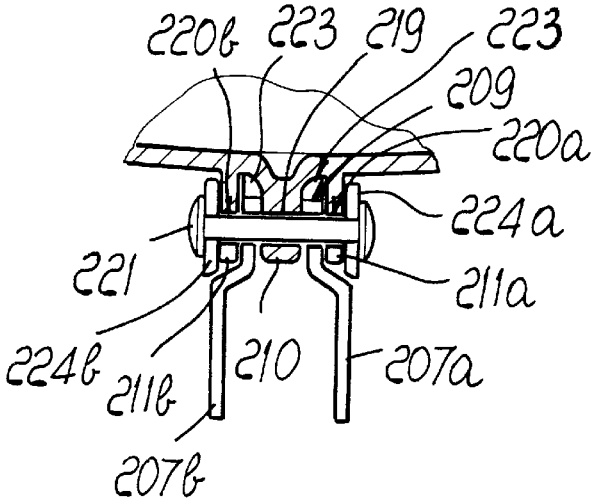
FIG. 11 is a sectional view, taken along the plane XI—XI of FIG. 10.
Figure 12:
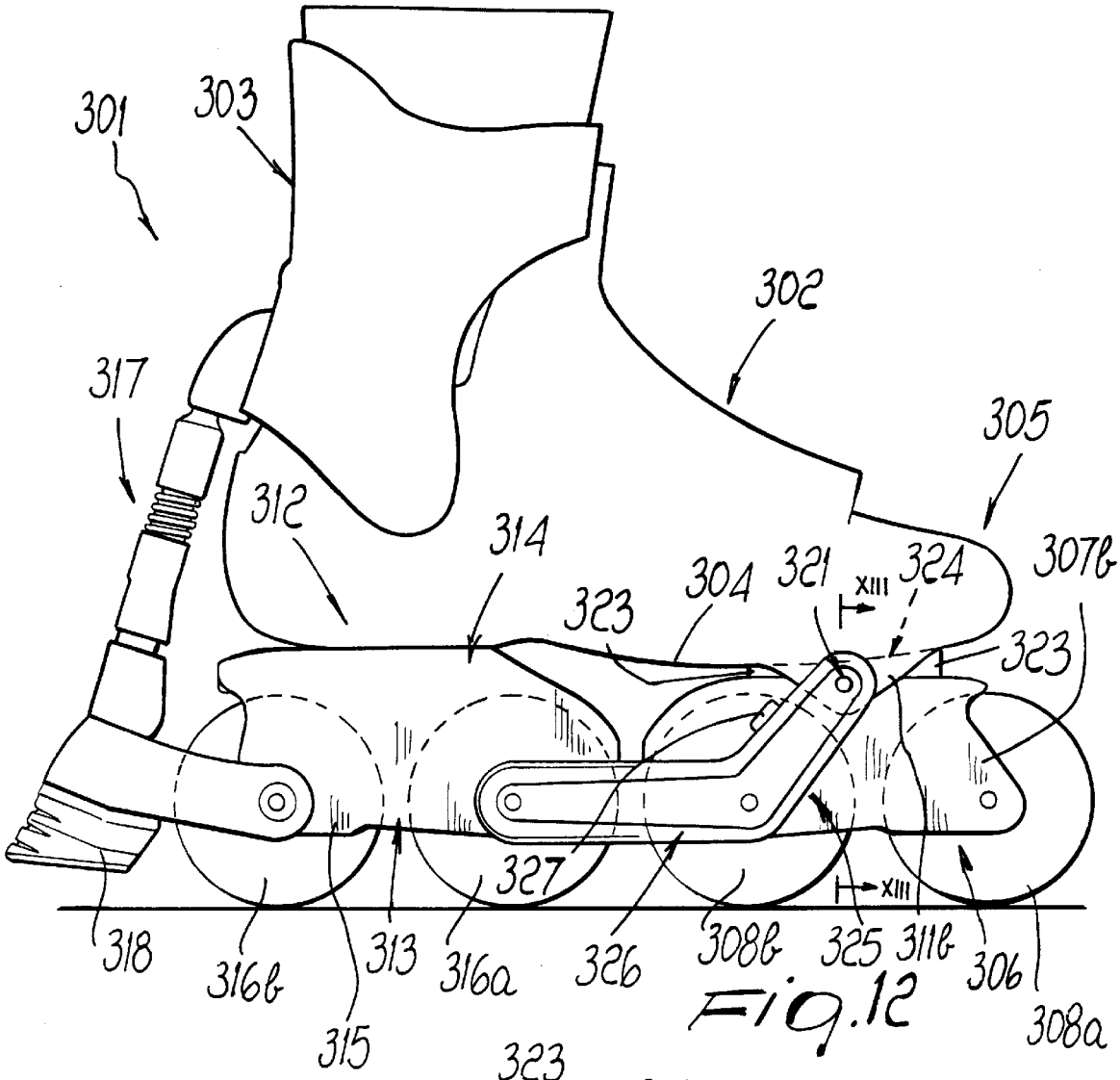
FIG. 12 is a side view of the skate with in-line wheels in the inactive condition.
Figure 13:
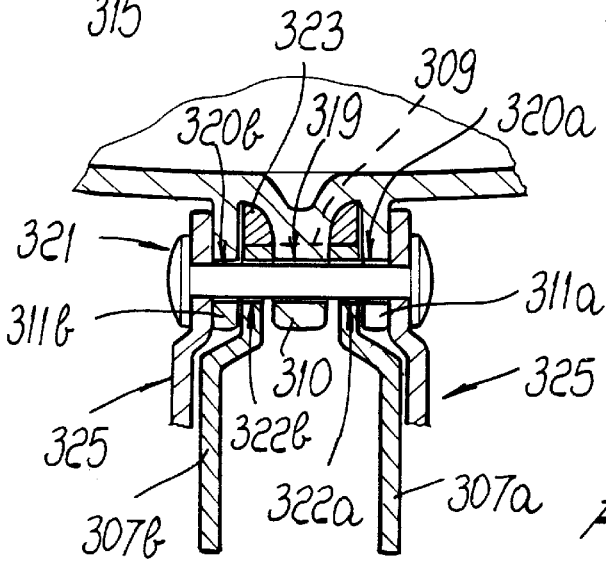
FIG. 13 is a sectional view, taken along the plane XIII—XIII of FIG. 12.

The operation of the invention is as follows: during thrusting, which is shown schematically in FIG. 10, the skater can lift the second frame 213 by the presence of the pair of third tabs 224*a* and 224*b*, localizing forces exclusively at the first frame 206 and therefore at the first wheels 208*a* and 208*b*.

Furthermore, use of the particular configuration of the second frame and of the pair of third tabs allows to shift the rotation point at the axis of the pivot 221 directly below the sole of the shell.

It has been observed that the invention has achieved the intended aim and objects, since it is adapted to transmit forces in an optimum manner during thrusting and at the same time allows a correct anatomical movement of the foot.

The presence of the pair of third tabs in fact allows, while having a monolithic shell, to lift the second frame, so that the user can transmit forces, during thrusting, selectively only at the front part of the foot, at the same time allowing to achieve optimum lateral containment and rigidity of the entire skate throughout sports practice.

With reference to FIGS. 12–15, the reference numeral 301 designates a skate constituted by a shell 302, whereto it is possible to articulate a quarter 303 associated at the malleolar region by means of appropriate studs or rivets.

The shell 302 is formed monolithically, is preferably made of plastics, and has a lower region that forms a sole 304.

A first frame 306 is associated below the sole 304 in the metatarsal region 305 and is U-shaped in transverse cross-section; at least one pair of first wheels 308*a* and 308*b* is pivoted between the first wings 307*a* and 307*b* of said first frame, which protrude towards the ground.

The first frame 306 has a first base 309 for interconnecting the first wings 307*a* and 307*b*; said base is perforated, so as to form a seat for the positioning of a first tab 310 in said base, and said first tab protrudes below the sole 304 in the metatarsal region 305.

A pair of second tabs 311*a* and 311*b* also protrudes below the sole 304 so as to lie approximately parallel to the first tab; said second tabs are arranged externally with respect to the first wings 307*a* and 307*b* of the first frame.

A second frame 313 is also associated below the sole 104, approximately at the heel region 312; said second frame, too, is U-shaped in transverse cross-section, forming a second base 314 for anchoring to the sole 304, two second wings 315 protruding from said second base; at least one pair of second wheels 316*a* and 316*b* is pivoted between said second wings.

An adapted brake 317 is advantageously associable at the quarter 303 and has a pad 318 which interacts with the ground when said cuff is rotated backwards.

A first hole 319 and second holes 320*a*, 320*b* are formed, along the same axis, respectively at the first tab 310 and at the second tabs 311*a* and 311*b*; said holes accommodate a pivot 21 that also passes at adapted third holes 322*a* and 322*b* formed at the first wings 307*a* and 307*b* of the first frame 306 proximate to the first base 309.

At least one means adapted to limit the oscillation of the second frame 313 and/or of the shell 302 is interposed between the lower surface of the sole 304 and the first base 309; said means is constituted by a flexible insert 323 which is preferably rectangular in plan view and has a hole that allows the insertion of the first tab 310.

The skate also has a rigid connecting element 324 that is adapted to connect the first frame, the second frame, and the shell to one another; said connecting element is constituted by two profiles that are L-shaped and therefore have respective third wings 325 and fourth wings 326; the tips of said wings are pivoted respectively at the pivot 321 and at the pivoting axis of the second wheel 316*a* of the second frame 313 that is adjacent to the first frame 306, which is arranged in front.

Advantageously, the profiles constituting the connecting element are arranged outside the first and second frames.

It is also possible to advantageously provide narrower portions, adapted to contain the extension of the pivot 321, at the first frame and at the third wings 325.

The third wings 325 and the fourth wings 326 are thus arranged approximately parallel to the first wings 307*a* and 307*b* and to the second wings 315 of the respective first and second frames, so as to allow mutual sliding.

The elbow of the connecting element 324, which joins the third wing 325 and the fourth wing 326, is furthermore arranged approximately at the first wheel 308*b* of the first frame 306 that is adjacent to the second frame 313, where each profile is pivoted at the first wheel 308*b* and therefore between the first wings 307*a* and 307*b* of the first frame 306.

Additional means for limiting the oscillation of the second frame and/or of the shell are constituted by at least one lug 327 that protrudes at least from one of the first wings 307*a* and 307*b* in a region lying to the rear of the perimetric edge of the third wings 325 that is directed towards the heel region 312; said lug is arranged so as to abut against the perimetric edge of the third wings 325 in the inactive condition in which all the wheels rest on the ground.

Figure 14:
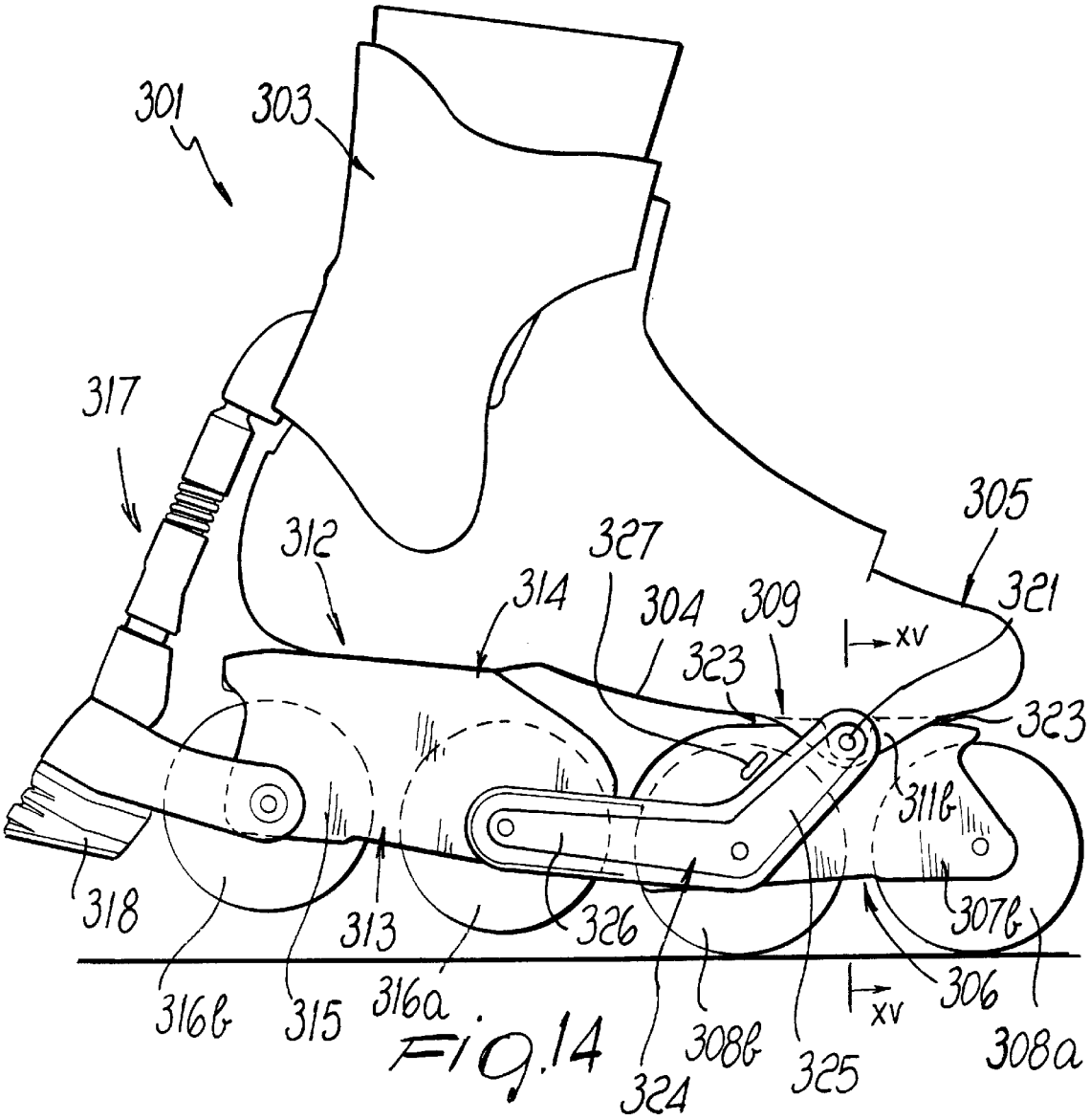
FIG. 14 is a side view of the skate during thrusting while skating.
Figure 15:
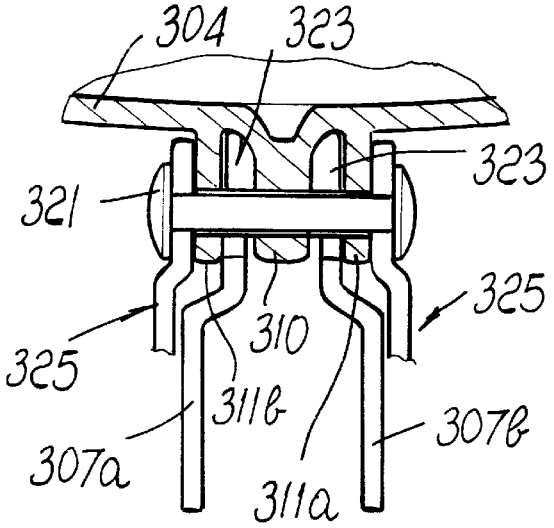
FIG. 15 is a sectional view, taken along the plane XV—XV of FIG. 14.

The operation of the invention is as follows: during thrusting, which is shown schematically in FIG. 14, the skater can lift the second frame 313 by the presence of the connecting element 324, localizing forces exclusively at the first frame 306 and therefore at the first wheels 308*a* and 308*b*.

Furthermore, use of the L-shaped profile for the connecting element allows to shift the rotation point at the axis of the first wheel of the first frame and therefore in a point that is very close to the ground and is anatomically favorable for the rotation of the foot during thrusting.

It has been observed that the invention has achieved the intended aim and objects, since it is adapted to transmit forces in an optimum manner during thrusting and at the same time allows a correct anatomical movement of the foot.

The connecting element in fact allows, while having a monolithic shell, to lift the second frame, so that the user can transmit forces, during thrusting, selectively only at the front part of the foot, at the same time allowing to achieve optimum lateral containment and rigidity of the entire skate throughout sports practice.

Figure 16:
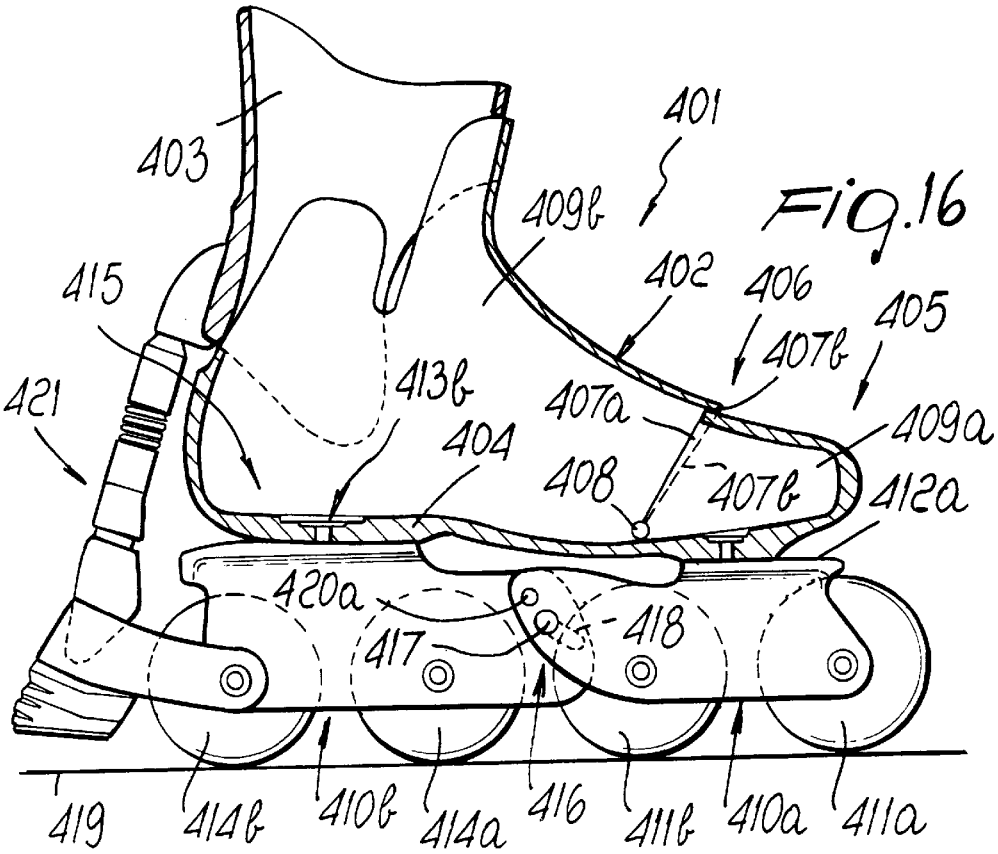
FIG. 16 is a partially sectional side view of the skate with in-line wheels.
Figure 17:
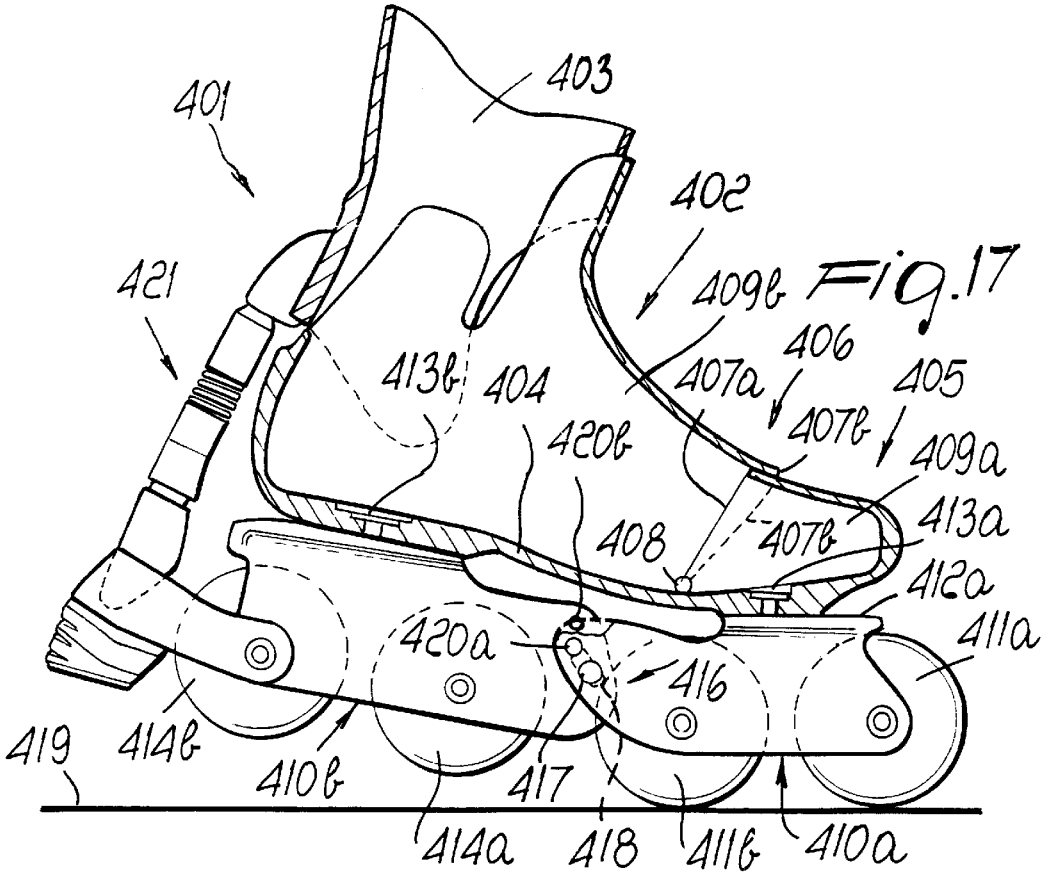
FIG. 17 is a view of the skate of FIG. 16 in the thrusting step during sports practice.

With reference to FIGS. 16–17, the reference numeral 401 designates a skate constituted by a shell 402, to which it is possible to articulate a quarter 403 that is associated at the malleolar region by means of appropriate studs or rivets.

The shell 402 is formed monolithically, is preferably made of plastics, and has a lower region that forms a Role 404.

The shell 402 has, proximate to the tip region 405, an articulation 406 constituted by a slit that is formed on an approximately transverse plane starting from the vicinity of the sole 404; said slit forms a first flap 407*a* and a second flap 407*b* having such a shape as to allow their partial overlap, even in the inactive condition, and particularly the insertion of the first flap 407*a* in the second flap 407*b*.

During sports practice, while thrusting and flexing the foot, the mutual overlap of the first and second flaps 407*a* and 407*b* increases, thus facilitating the flexing of the foot.

The first and second flaps 407*a* and 407*b* have, proximate to the sole 404, a curved shape that is adapted to form a circular recess 408; said recess 408 allows to improve the flexibility, and therefore the overlap, of said first and second flaps 407*a* and 407*b*.

The articulation 406 forms, for the shell 402, a first front body 409*a* that is arranged at the tip region 405 starting from the flap 407*a*; said first body 409*a* allows to contain and secure the front part of the foot.

The articulation 406 also forms a second body 409*b* which, starting from the second flap 407*b*, allows to contain and secure the rear part of the user's foot.

A first frame 410*a* is associated in a downward region with the first body 409*a*; the transverse cross-section of said frame is U-shaped, and at least one pair of first wheels 411*a* and 411*b* is pivoted between the first wings of said frame, which protrude downwards.

The first frame 410*a* is constituted by a first flat base 412*a* for connecting the first wings, which is connected below the sole 404 through the interposition of adapted connecting means, such as rivets, that are accommodated in a complementarily shaped first seat 413*a* that is formed on the sole 404 that lies below the first body 409*a*.

The first wings of the first frame 410a protrude in the opposite direction with respect to the tip region 405.

A second frame 410*b* is also associated, in a downward region, with the second body 409*b* in the region of the heel 415; said second frame is U-shaped in a transverse cross-section, and at least one second pair of wheels 414*a* and 414*b* is pivoted between its second wings, which protrude below a second connecting base 412*b*.

The second base 412*b* is connected to the sole 404 through the interposition of adapted connecting means, such as rivets or couplings inserted at a complementarily shaped second seat 413*b* formed on the sole 404 at the heel region 415.

The second base 412*b* is preferably narrower than the first base 412*a*, so as to allow the partial insertion and adjacent arrangement, along approximately parallel planes, of the second wings of the second frame 410*b* with respect to the first wings of the first frame 410*a*.

The first and second frames 410*a* and 410*b* have means 416 for their mutual guiding and sliding.

Said means 416 are constituted by a pivot 417 that is associated and blended at right angles with respect to the tips of the first wings of the first frame 410*a* in a region that is intermediate between two of said first and second wheels that are adjacent to each other; the first pivot 417 slides at a slot 418 that is formed on the second wings of the second frame 410*b* that are adjacent to the first wings of the first frame 410*a*.

The slot 418 has a curved shape, the concavity whereof is directed at the tip region 405.

The pivot 417 can be arranged at the upper end of the slot 418 if the pair of first wheels 411*a* and 411*b* and the pair of second wheels 414*a* and 414*b* rest on the ground, generally designated by the reference numeral 419; during thrusting, instead, as shown in FIG. 17, the foot flexes, and the second body 409*b* and therefore the second frame 410*b* rise, forcing the sliding of the pivot 417 inside the slot 418 until it reaches the lower end of said slot, which constitutes a stroke limiter.

Advantageously, the first frame 410*a* and the second frame 410*b* have, on each one of said first and second wings, respectively a first hole 420*a* and a second hole 420*b*, which have the same axis in the inactive condition, are arranged above the means 416, and allow the insertion of a pivot or screw that allows to lock the skate 401 in the horizontal condition, so that the pair of first and second wheels 411*a* and 411*b*, 414*a* and 414*b* rest on the ground 419 so as to prevent, according to the user's requirements, the rotation of the skate 401.

A conventional brake 421 is associated with the skate 401 to the rear.

The operation of the skate is as follows: during thrusting, the flexing of the foot and the rise of the rear part thereof is allowed by the articulation 406 formed on the shell 402, which is provided by the mutual overlap of the first and second flaps 407*a* and 407*b* of the first and second bodies 409*a* and 409*b*.

The connection of the second body 409*b* to the second frame 410*b* allows the latter to rise with respect to the ground 419, whereas the sliding of the pivot 417 in the slot 418 allows guided lifting.

It has been observed that the invention has achieved the intended aim and objects, said invention being adapted to transmit forces in an optimum manner during thrusting, at the same time allowing a correct anatomical movement of the foot; the articulation 406 provided on the shell 402 in fact allows to flex the foot naturally, producing more thrust for an equal physical effort.

The sliding and guiding means 416 allow to lift the second frame 410*b* so that the user can thus transmit forces, during thrusting, selectively and exclusively at the front region of the foot; at the same time, said means 416 allow to achieve optimum lateral containment and rigidity of the entire skate throughout sports practice.

Figure 18:
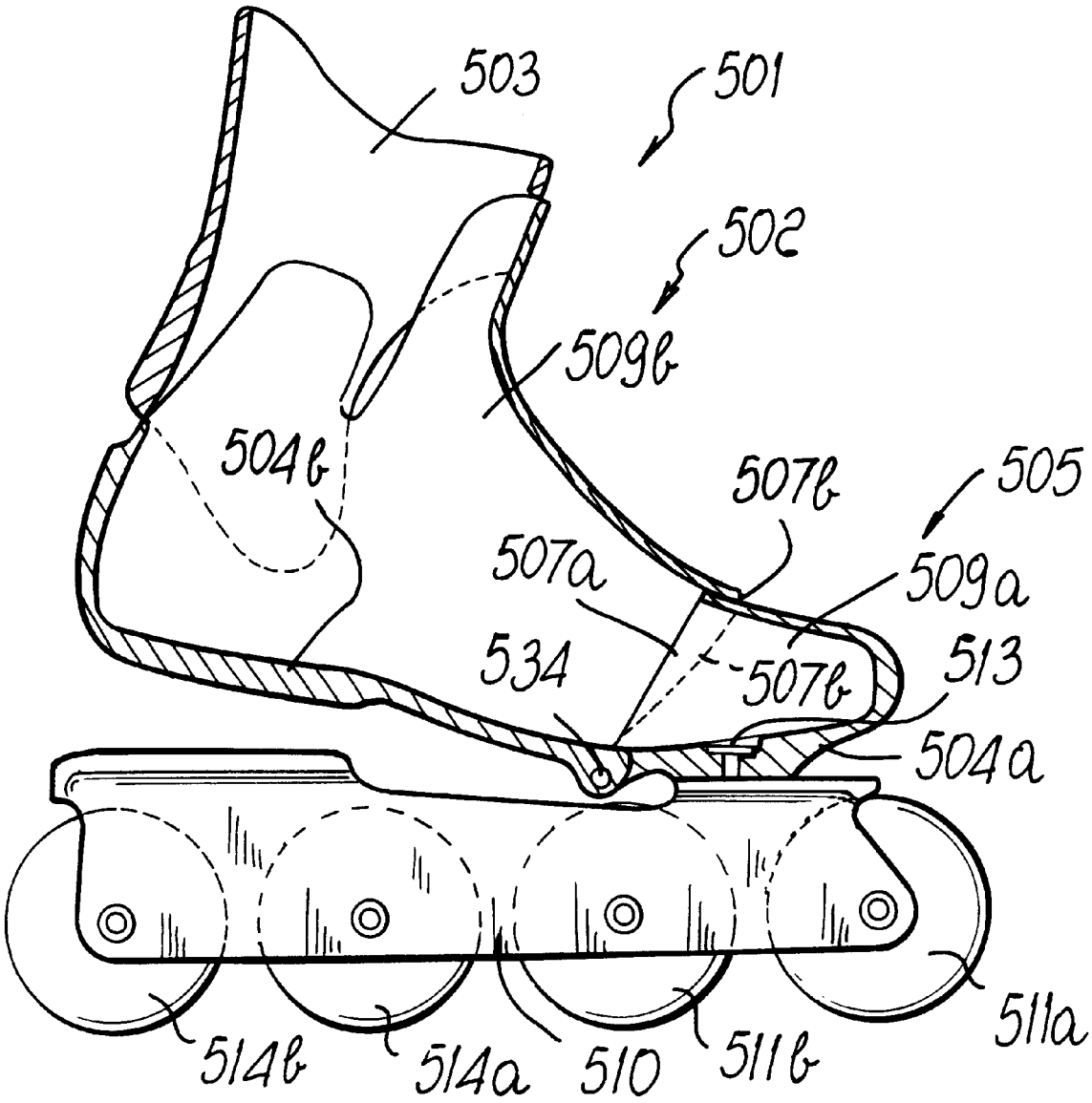
FIG. 18 is a partially sectional side view of still a further embodiment of the skate.

FIG. 18 illustrates still a further embodiment, in which the numeral 501 designates a skate constituted by a shell 502.

The shell 502 is constituted by a first front body 509*a*, which is arranged proximate to he toe region 505 and adapted to surround it, and by a separate second rear body 509*b*, to which a quarter 503 can be articulated.

The first and second bodies 509*a* and 509*b* have, respectively, a first sole 504*a* and a second sole 504*b* which are transversely and rotatably associated with each other, at their ends that can be arranged mutually adjacent, by means of a hinge-like articulation that comprises an adapted transverse connecting screw or pivot 534.

The first and second bodies 509*a* and 509*b* have, respectively, a first flap 507*a* and a second flap 507*b*, which have such a shape as to allow their partial overlap, even in the inactive condition, and particularly the insertion of the first flap 507*a* in the second flap 507*b*.

A frame 510 is associated below the first body 509*a* and has a U-shaped transverse cross-section; at least one pair of first and second wheels, designated respectively by the reference numerals 511*a* and 511*b*, 514*a* and 514*b*, is pivoted between the first wings of said frame, which protrude downwardly.

The frame 510 is connected, in a downward region, to the first sole 504*a* of the first body 509*a* through the interposition of adapted connecting means, such as rivets or couplings, that are accommodated in a complementarily shaped seat 513 formed on said first sole 504*a*.

This solution, too, allows to achieve the intended aim and objects, since the second body can rise from the frame during thrusting, which becomes localized, i.e., entrusted to the front region.

The materials and the dimensions constituting the individual components of the skate according to the invention may be the most appropriate according to the specific requirements.

The contents of the U.S. patent application Ser. No. 08/756,772 filed on Nov. 26, 1996, and U.S. Pat. No. 5,634,648 are incorporated herein by reference.

What is claimed is:

1. Skate with in-line wheels comprising:

an upper for accommodating a user's foot, said upper having a first portion and a second portion, said first portion pivoting with respect to said second portion during a pivoting use configuration of the skate;

a wheel supporting frame downwardly connected to said upper;

a plurality of in-line wheels rotatably supported by said wheel supporting frame;

said wheel supporting frame comprising a first frame member and a second frame member, said first frame member being downwardly connected to said first portion of said upper and said second frame member being downwardly connected to said second portion of said upper such that said first frame member pivots with respect to said second frame member when said first portion and said second portion of said upper mutually pivot with respect to one another during said pivoting use configuration of the skate;

a slot extending through said first frame member, and a transverse element connected to and moveable with said second frame member, a portion of said transverse element being positioned within said slot so that said portion slides within said slot as said first and second frame members move relative to each other;

a first lock surface provided on said first frame member and a second lock surface provided on said second frame member, said first and second lock surfaces being mutually aligned in a locking configuration of said first and second frame members each of said lock surfaces being spaced from said slot; and a lock element removably and selectively engageable with said first and second lock surfaces when said first and second frame members are in said locking configuration for selectively preventing mutual pivoting between said first and second frame members and for selectively preventing mutual pivoting between said front and rear portions of said upper.

2. The skate of claim 1 wherein said first and second frame members are U-shaped and respectively have first and second wings protruding downwardly from said upper and between which said plurality of wheels are pivotably supported, portions of said first wings being arranged in overlapping contact with portions of said second wings for providing lateral force transmission of said frame members.

3. The skate of claim 1 comprising guiding and mutual sliding means for slidingly guiding said first frame member with respect to said second frame member when said first and second frame members pivot with respect to each other during said pivoting use configuration of the skate.

4. The skate of claim 1, wherein said slot is curved.

5. The skate of claim 1 wherein said upper comprises a monolithic shell.

6. The roller skate of claim 1 wherein said first lock surface is defined by a first locking hole provided on said first frame member, and said second lock surface is defined by a second locking hole provided on said second frame member.

7. The skate of claim 1 wherein said upper comprises a monolithic shell forming said first portion and said second portion and having, proximate to a sole of tie skate and it a front foot region, at least on; articulation which pivotably connects said first portion and said second portion of said upper such that said first portion pivots with respect to said second portion during a pivoting use configuration of the skate.

8. The skate of claim 7 wherein said first portion is adapted for securing a front part of a user's foot and said second portion is adapted for securing at least a heel of a user's foot.

9. The skate of claim 8 wherein said first and second portions have, respectively, a first flap and a second flap being, shaped to partially overlap in an inactive configuration of the skate and in said pivoting use configuration of he skate.

10. The roller skate of claim 1 wherein said slot is curved.

11. The roller skate of claim 10 wherein said slot has an upwardly directed concavity.

12. A roller skate comprising:

a boot with a flexible sole;

first and second wheel-supporting frames attached to said sale, each of said wheel-supporting frames having a plurality of substantially parallel wings, at least out of said wings of said first frame partially overlapping and slidably contacting one of said wings of said second frame;

a transverse element connected to and moveable with said first frame, said transverse element being moveable in a curved path relative to said second frame as said sole flexes, said transverse element being slidable relative to said second frame;

a plurality of lock surfaces defined by said wings of said first and second frames, said lock surfaces being aligned when said sole is in a non-flexed position; and a lock element moveable between a first position in which said lock element is engaged with said lock surfaces, thus preventing said front and rear wings from sliding relative to each other and preventing said sole from flexing, and a second position in which said lock element is disengaged sufficiently to permit said sliding and flexing.

13. The roller skate of claim 12, wherein said lock surfaces are defined by a plurality of holes defined by said wings of said first and second frames, said holes being aligned when said sole is in said non-flexed position; and said lock element moveable between said first position in which said lock element is disposed through said holes, thus preventing said first and second wings from sliding relative to each other and preventing said sole from flexing, and said second position in which said lock element is withdrawn sufficiently to permit said sliding and flexing.

14. The roller skate of claim 12 further comprising:

a first stop surface on said second frame and a second stop surface on said transverse element, said first and second stop surfaces being arranged so that they will approach and contact each other as said sole flexes, thereby limiting the extent to which said sole may flex.

15. A roller skate comprising:

a boot with a flexible sole having a toe area and a heel area;

a front wheel supporting frame connected to said toe area, said front frame having two downwardly-extending first wings;

a rear wheel-supporting frame connected to said heel area, said rear frame having two downwardly-extending second wings, one of said first wings and one of said second wings being in partially overlapping and slidable contact with each other;

a first stop surface on one of said frames and movable with said one of said frames as said sole flexes, a transverse element connected to and movable with the other of said frames as said sole flexes, said transverse member having a second stop surface, said first and second stop surfaces being arranged so that they approach each other and can contact each other as said sole flexes, thereby limiting the extent to which said sole can flex and;

said first wings and said second wings further defining a plurality of lock surfaces, said lock surfaces being aligned when said sole in a non-flexed orientation, wherein each of said stop surfaces is spaced from both of said lock surfaces; and a lock element moveable between a first position in which said lock element is engaged with said lock surfaces, so as to prevent the mutual sliding of said first and second wings and thereby restricting the flexibility of said sole, and a second position in which said lock element is disengaged sufficiently to permit the mutual sliding of said first and second wings and the flexibility of said sole.

16. The roller skate of claim 15 wherein said first wings and said second wings define a plurality of holes, said lock surfaces being on inner surfaces of said holes, said holes being aligned when said sole in said non-flexed orientation.

17. The roller skate of claim 15 wherein said transverse element moves in a curved path relative to the other of said frames when said sole flexes.

18. A roller skate comprising:

a boot with a flexible sole, said sole having toe and heel portions;

a first wheel-supporting frame connected to said toe portion of said sole, said front wheel-supporting frame including a first panel descending downwardly from said sole;

a second wheel supporting frame including a second panel descending downwardly from said sole, said first and second frames being capable of rotating relative to each other when said sole is flexed, said first panel being in slidable contact with said second panel;

a slot defined by said first frame, said slot having an inner surface;

a transverse element connected to and moveable with said second fame as said sole flexes, a portion of said transverse element being positioned within said slot so that said portion slides within said slot as said first and second panels move relative to each other;

said first and second panels further defining a plurality of lock surfaces, said lock surfaces being aligned when said sole in a non-flexed orientation wherein each of said lock surfaces is spaced from said inner surface of said slot; and a lock element moveable between a first position in which said lock element is engaged with said plurality of lock surfaces, so as to prevent the mutual sliding of said first and second panels and thereby restricting the flexibility of said sole, and a second position in which said lock element is disengaged sufficiently to permit the mutual sliding of said first and second panels and the flexibility of said sole.

19. The roller skate of claim 18 wherein said lock surfaces are defined by a plurality of holes provided in said first and second panels.

20. A roller skate comprising:

a boot with a flexible sole, said sole having toe and heel portions;

a first wheel-supporting frame connected to said sole, said first wheel-supporting frame including two first panels descending downwardly from said sole; and a second wheel-supporting frame connected to said sole, said second wheel-supporting frame including two second panels descending downwardly from said sole, said first and second frames capable of rotating relative to each other when said sole is flexed, one of said first panels being in slidable contact with one of said second panels;

a slot defined by one of said first panels;

a transverse element connected to and moveable with one of said second panels as said sole flexes, said transverse element being positioned with in said slot so that said transverse element slides in a curved path relative to said first wheel-supporting frame as said first and second panels move relative to each other;

wherein at least one of said first panels further defines a first lock surface and at least one of said second panels further defines a second lock surface, said first and second lock surfaces being aligned when said sole is not flexed; and a lock element capable of being engaged with said first and second aligned lock surfaces, so that said lock element contacts said first and second lock surfaces, thereby inhibiting the relative sliding of said first and second panels and inhibiting the relative rotation of said front and rear frames.

21. The roller skate of claim 20 wherein each of said fist panels is in slidable contact with one of said second panels.

22. The roller skate of claim 20 wherein said at least one of said first panels defines a first hole having a first inner surface defining said first lock surface and said at least one of said second panels defines a second hole having a second inner surface defining said second lock surface, said first and second holes being aligned when said sole is not flexed; and said lock element capable of being inserted through said first and second aligned holes, so that said lock element contacts said first and second inner surfaces, thereby inhibiting the relative sliding of said first and second panels and inhibiting the relative rotation of said front and rear frames.

23. The roller skate of claim 22 wherein said lock element comprises a screw.

24. A roller skate comprising:

a boot with a flexible sole, said sole having a first end and a second end;

a first frame connected to said sole near said first end;

a second frame connected to said sole near said second end;

at least one first wheel rotatably connected to said first frame;

at least one second wheel rotatably connected to said second frame;

a transverse element connected to and moveable with said first frame, said transverse element being slidably moveable in a curved path relative to said second frame;

wherein said first frame further defines a first lock surface and said second frame further defines a second lock surface, said first lock surface capable of being aligned with said second lock surface; and a lock element engageable with said aligned first and second lock surfaces, thereby fixing the relative positions of said first and second frames.

25. The roller skate of claim 24 further comprising;

a first stop surface on said second frame and a second stop surface on said transverse element such that said first and second stop surfaces can approach and contact each other as said sole flexes, thereby limiting the extent to which said sole can flex.

26. The roller skate of claim 25 wherein said first stop surface is on the interior of a slot, said slot being defined by said second frame.

27. The roller skate of claim 26 wherein said slot is curved.

28. The roller skate of claim 24 wherein said first frame defines a first hole defining said first lock surface and said second frame defines a second hole defining said second lock surface, said first hole capable of being aligned with said second; and said lock element positionable through said aligned first and second holes, thereby fixing the relative positions of said first and second frames.

29. A roller skate comprising:

a flexible boot;

a flexible wheel-supporting frame connected to said boot, said frame comprising a first frame member and a second frame member, said first and second frame members capable of moving relative to each other as said boot flexes, said first frame member comprising a first lock surface and a first stop surface, said first stop surface being on an inner surface of a slot defined by said first frame member, and said second frame member comprising a second lock surface, said first and second lock surfaces being aligned when said boot is in a non-flexed position;

a transverse element connected to and moveable with said second frame member, said transverse element comprising a second stop surface, said first and second stop surfaces being positioned so that they can approach and contact each other as said first and second frame members move relative to each other, thereby limiting the relative movement of said first and second frame members, wherein each of said stop surfaces is spaced from both of said lock surfaces; and a lock element moveable between a first position in which said lock element is set in contact with said aligned first and second lock surfaces, thus preventing said first and second frame members from moving relative to each other, and a second position in which said lock element is withdrawn sufficiently to permit said first and second frame members to move relative to each other.

30. The skate of claim 29 wherein said first frame member defines a first hole and said second frame member defines a second hole, said first and second lock surfaces being on inner surfaces of said first and second holes, respectively.

31. The skate of claim 29 wherein said lock surfaces are spaced vertically above said stop surfaces, so that said lock surfaces are between said stop surfaces and said boot.

32. The skate of claim 29 wherein said slot is curved.

33. A roller skate comprising:

a flexible boot, a first same section connected to said boot and a second frame section connected to said boot, said first and second frame sections capable of moving relative to each other as said boot flexes, said first frame member comprising a first lock surface and said second frame member comprising a second lock surface, and first and second lock surface being aligned when said boot is in a non-flexed position;

a transverse element connected to and moveable with said first frame sections, so that said transverse element moves in a curved path relative to said second frame section and said transverse element is slidable relative to said second frame section; and a lock element movable between a first position in which said lock element is set in contact with said aligned first and second lock surfaces, thus preventing said first and second frame sections from moving relative to each other, and a second position in which said lock element is withdrawn sufficiently to permit said first and second frame sections to move relative to each other.

34. The skate of claim 33 wherein said first frame section defines a first hole and said second frame section defines a second hole, said first and second lock surfaces being on inner surfaces of said first and second holes, respectively.

35. An in-line roller skate comprising;

a boot with a flexible sole;

a flexible-wheel supporting frame connected to said sole, said frame including a first frame member and a second frame member;

a first stop surface connected to said first frame member and a second stop surface connected to said second frame member, said first stop surface and said second stop surface being capable of approaching each other when said sole flexes, said first stop surface and said second stop surface being capable of contacting each other, thereby limiting the extent to which said sole can flex;

a first lock surface and a second lock surface connected to said flexible wheel-supporting frame, wherein each of said lock surfaces is spaced from both of said stop surfaces;

a lock element moveable between a first position in which said lock element is engaged with said lock surfaces, so as to limit the flexibility of the frame, and a second position in which said lock element is disengaged sufficiently, so as to not limit the flexibility of the frame.

36. The in-line roller skate of claim 35 wherein said first stop surface is an inner surface of a slot defined by said first frame member.

37. The in-line roller skate of claim 35 wherein said second stop surface is on a transverse member connected to said second frame member.

38. The in-line roller skate of claim 35 wherein said first lock surface is an inner surface of a hole defined by said first frame member.

39. The in-line roller skate of claim 35 wherein said first lock surface connected to said first frame member and said second lock surface connected to said second frame member.

40. The in-line roller skate of claim 35 wherein said boot further comprises toe and heel portions and said first frame member is connected to said toe portion of said boot and said second frame member is attached to said heel portion of said boot.

41. The in-line roller skate of claim 36 wherein said slot is curved.

42. The in-line roller skate of claim 36 wherein said second stop surface is on a transverse member connected to said second frame member, said transverse member being at least partially disposed within said slot.

43. The in-line roller skate of claim 38 wherein said second lock surface is an inner surface of a hole defined by said second frame member.

* * * * *